US010012391B2

(12) United States Patent
Alvarado

(10) Patent No.: US 10,012,391 B2
(45) Date of Patent: Jul. 3, 2018

(54) BURNER AND MODULAR HEAT UTILIZING APPLIANCES THEREFOR

(71) Applicant: Jesus Alvarado, Van Nuys, CA (US)

(72) Inventor: Jesus Alvarado, Van Nuys, CA (US)

( * ) Notice: Subject to any disclaimer, the term of this patent is extended or adjusted under 35 U.S.C. 154(b) by 160 days.

(21) Appl. No.: 15/186,527

(22) Filed: Jun. 19, 2016

(65) Prior Publication Data

US 2017/0363297 A1 Dec. 21, 2017

(51) Int. Cl.

| | |
|---|---|
| ***F24B 5/02*** | (2006.01) |
| ***F24B 1/02*** | (2006.01) |
| ***F24B 13/00*** | (2006.01) |
| ***F24B 13/02*** | (2006.01) |
| ***F24B 1/00*** | (2006.01) |

(52) U.S. Cl.

CPC ..... *F24B 5/026* (2013.01); *F24B 1/003* (2013.01); *F24B 1/022* (2013.01); *F24B 5/023* (2013.01); *F24B 5/025* (2013.01); *F24B 13/002* (2013.01); *F24B 13/008* (2013.01); *F24B 13/02* (2013.01)

(58) Field of Classification Search

CPC ..... F24B 13/002; F24B 5/02; F24B 5/023; F24B 5/025; F24B 5/026; F24B 1/003; F24B 13/006; F24B 13/008; F24B 1/207; F24B 1/022; A47J 36/2477; A47J 36/26

See application file for complete search history.

(56) References Cited

U.S. PATENT DOCUMENTS

| | | | | |
|---|---|---|---|---|
| 5,176,124 | A * | 1/1993 | Wrasse | A47J 37/0704 126/25 R |
| 5,195,423 | A * | 3/1993 | Beller | A23B 4/052 99/340 |
| 5,500,237 | A | 3/1996 | Gell, Jr. et al. | |
| 6,189,528 | B1 | 2/2001 | Oliver | |
| 6,363,925 | B1 | 4/2002 | Chavana, Jr. et al. | |
| 6,394,082 | B1 * | 5/2002 | Rhynsburger | F23J 1/00 126/243 |
| 6,615,821 | B1 * | 9/2003 | Fisenko | A47J 37/0704 126/15 R |
| 7,530,351 | B2 | 5/2009 | Leverty | |
| 8,910,622 | B2 | 12/2014 | Mishra et al. | |
| 2008/0245357 | A1 | 10/2008 | Meether et al. | |

(Continued)

OTHER PUBLICATIONS

Solo Stove; Amazon.ca product; https://www.amazon.ca/dp/B007DBD3IU/ref=sspa_dk_detail_0?psc=1 1/; accessed Jan. 24, 2018; dated Oct. 22, 2012.*

*Primary Examiner* — Daniel J Colilla

(57) ABSTRACT

A burner for burning fuels and modular heat utilizing appliances therefor. The burner includes a fuel holder, an outer wall surrounding the fuel holder and defining a combustion chamber, and optionally, a second wall surrounding the outer wall. Air is inducted from an inlet which may be an ash pan pivotally coupled to the outer wall at the bottom to open the combustion chamber. Supplementary combustion air is conducted to just above the fuel holder by the outer wall. Additional supplementary combustion air is conducted to just above the fuel holder by the second wall. The burner may include a pivotally mounted cooking grate and a pivotally mounted solid cover for closing the combustion chamber, and supporting legs. Modules individually yet replaceably attachable to the burner include a closed or open cooker, a smoker, a space heater, and a pyrolyzer.

15 Claims, 3 Drawing Sheets

(56) References Cited

U.S. PATENT DOCUMENTS

| | | | | |
|---|---|---|---|---|
| 2009/0038605 | A1 | 2/2009 | Dahle et al. | |
| 2010/0083946 | A1* | 4/2010 | Cedar | F23B 20/00 126/25 B |
| 2011/0271949 | A1 | 11/2011 | Ortner et al. | |
| 2012/0060819 | A1 | 3/2012 | Hunt et al. | |
| 2015/0305554 | A1 | 10/2015 | Dorsten et al. | |
| 2017/0013999 | A1* | 1/2017 | Horsfield | A47J 37/0763 |

* cited by examiner

BURNER AND MODULAR HEAT UTILIZING APPLIANCES THEREFOR

FIELD OF THE INVENTION

The present disclosure relates to combustion apparatus, and more particularly, to a burner which may be part of a system including a plurality of interchangeable or modular heat utilizing appliances.

BACKGROUND OF THE INVENTION

Fuel burners are used to operate heat utilizing appliances, such as cooking grills, cooktops, food smoking apparatus, space heaters, and pyrolyzers. It is a great convenience to use a solid fuel in such a burner, as solid fuels such as firewood, charcoal briquettes, and others are readily available. However, despite availability of solid fuels, it is desirable to optimize efficiency of a burner, and to limit unburned fuel emissions.

It is also desirable to have modular heat utilizing appliances, so that only one burner need be acquired to operate diverse heat utilizing appliances.

Accordingly, there exists a need for an efficient, clean burning burner capable of being used with diverse heat utilizing appliances.

SUMMARY

The disclosed concepts address the above stated situation by providing a an efficient, clean burning burner and a system for removably attaching heat utilizing appliances thereto.

The burner has a combustion chamber enclosed by an outer wall surrounding a fuel holder. Air flows both through the fuel holder to support initial combustion, and also around the fuel holder, to be directed to flame and fumes just above the fuel holder to support secondary combustion. A shroud providing a second wall surrounds the outer wall, thereby establishing a flow path for tertiary combustion air also impinging on the flame and fumes, and also providing an external surface cool enough to avoid burns if casually contacted The burner has legs holding the combustion chamber well above ground level, and a pivotally coupled ash pan. A perforate food grate is pivotally coupled to the burner, and is movable to a deployed position above the flame, and to a stowed position to the side of the combustion chamber and associated outer walls. Opposite the perforate food grate, a cover is pivotally coupled to the burner, enabling the combustion chamber to be closed to prevent inadvertent ingress of dropped items, inadvertent exposure of the user to heat and exhaust fumes, and to suppress escape of live embers.

The burner has manual couplings for removably coupling modular heat utilizing appliances to the burner, the modular heat utilizing appliances including closed and open cookers, a food smoker, a space heater, and a pyrolyzer.

The nature of the disclosed concepts will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION OF THE EMBODIMENTS

Figure 1:
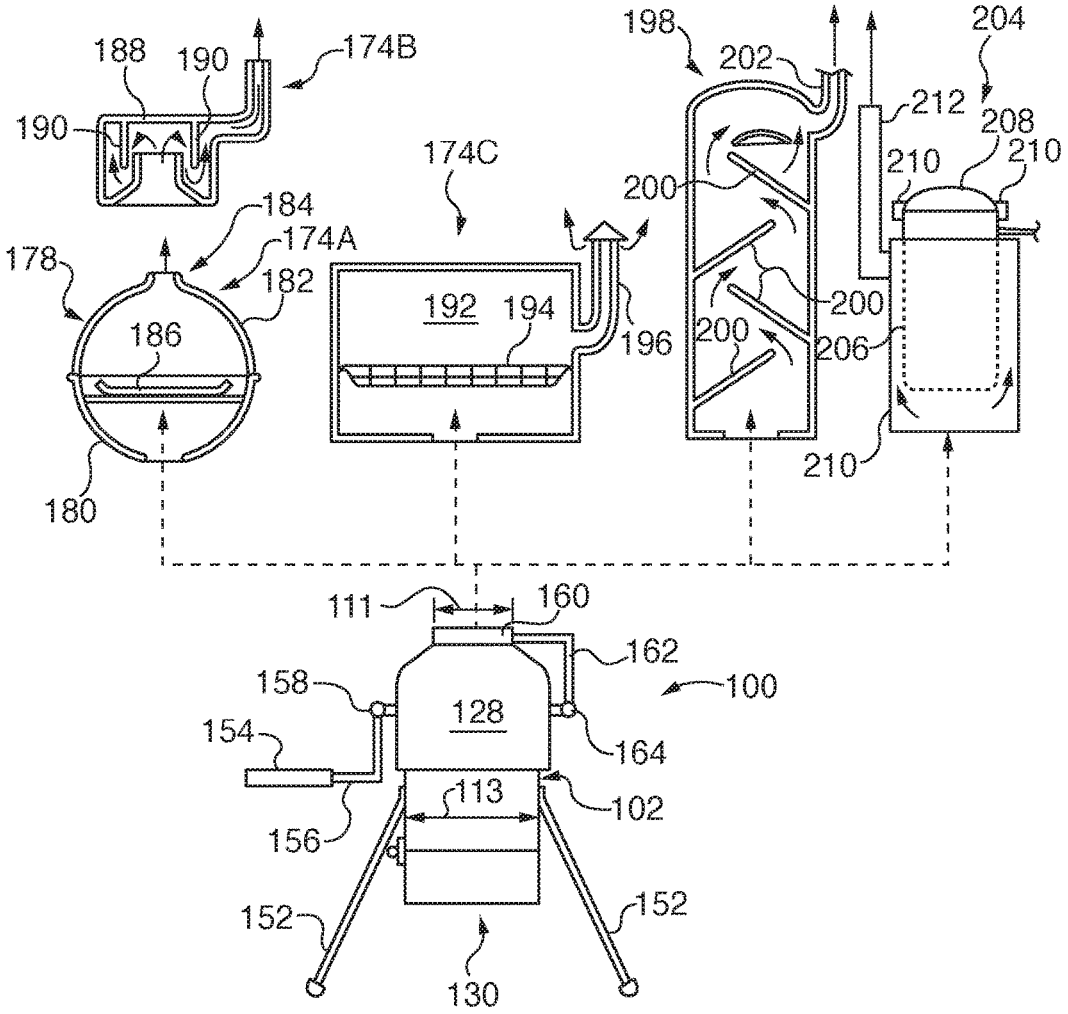
FIG. 1 is a schematic side view of a burner and modular heat utilizing appliances therefor, with some components shown in cross section, according to at least one aspect of the disclosure.

Referring first to FIG. 1, according to at least one aspect of the disclosure, there is shown an overview of a system comprising a burner 100 for a heat utilizing appliance and a plurality of interchangeable or modular heat utilizing appliances. Only one of the modular heat utilizing appliances is coupled to burner 100 at any one time.

Figure 2:
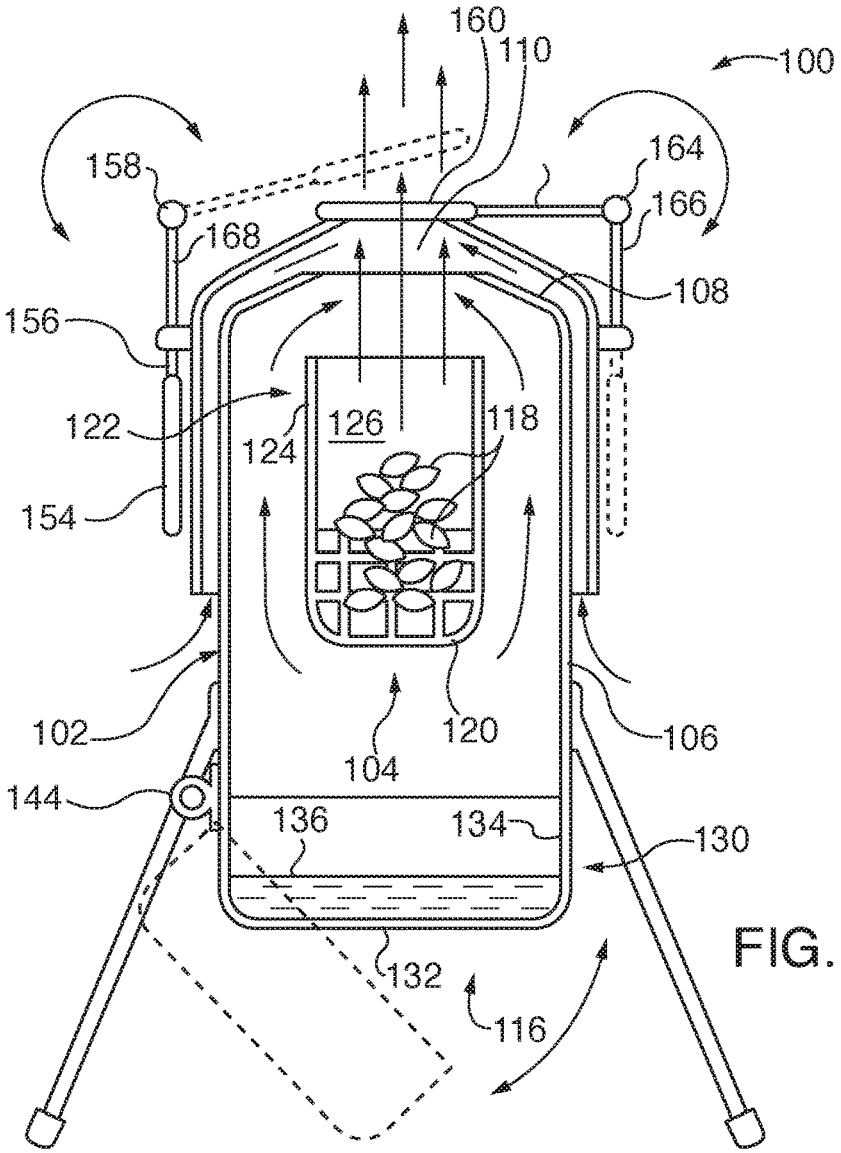
FIG. 2 is a schematic side cross sectional view of the burner of FIG. 1, according to at least one aspect of the disclosure.

Referring also to FIG. 2, there is shown in greater detail a burner 100 for a heat utilizing appliance. Burner 100 comprises a housing 102 and a fuel holder 104 within housing 100. Housing 102 may comprise a lateral wall 106 surrounding and spaced apart from fuel holder 104, and a top wall 108 including a constricted exhaust outlet 110 of transverse dimensions 112 (see FIG. 1) less than transverse dimensions 114 (see FIG. 1) of lateral wall 106. Constricted exhaust outlet 110 is located above fuel holder 104. An air inlet opening 116 admits air to fuel holder 104. Lateral wall 106 and top wall 108 are collectively configured to guide inducted air flowing around fuel holder 104 inwardly from a periphery of housing 102 to join exhaust products flowing upwardly through exhaust outlet 110 when solid fuel 118 is being burned in fuel holder 104, thereby supporting secondary combustion above fuel holder 104.

It should be noted at this point that orientational terms such as over and below refer to the subject drawing as viewed by an observer. The drawing figures depict their subject matter in orientations of normal use, which could obviously change with changes in body posture and position. Therefore, orientational terms must be understood to provide semantic basis for purposes of description only, and do not imply that their subject matter can be used only in one position.

Exhaust outlet 110 is constricted in that transverse dimension 111 of exhaust outlet 110 is less than a corresponding transverse dimension 113 of housing 102. This relationship causes top wall 108 and the immediately overlying portion of outer shroud 128 to channel products of combustion and secondary and tertiary combustion air towards exhaust outlet 110, so that heat may be concentrated advantageously.

In FIG. 2, hinges 158 of cover 154 and 164 of grill 160 are fixed to an outer shroud 128. Accordingly, respective arms 156 and 162 are L-shaped.

In FIGS. 1 and 2, arrows having outlined heads indicate flow of secondary and tertiary combustion air as combustion air flows by convection through burner 100. Arrows having solid, filled heads indicates flow of flames and heat produced by combustion of solid fuel 118. Constricted exhaust outlet 110 may be frustoconical, with the narrowest portion thereof at the center of top wall 108, as shown, to advantageously concentrate flames and heat at the center of burner 100.

Fuel holder 104 may comprise a perforate receptacle 120 enabling air inducted from air inlet opening 116 to come into combustion support relation to solid fuel 118 in fuel holder 104. Fuel holder 104 may comprise an imperforate lateral wall 124 above perforate receptacle 120. In some implementations (not shown) of burner 100, imperforate lateral wall 124 may be eliminated. Perforate receptacle 120 may be made from metallic wire welded into a mesh, for example. Other components of burner 100 exposed to heat of combustion may be fabricated from a suitable metallic alloy, such as a suitable steel.

Outer shroud 128 may surround and be spaced apart from upper portion 122 of housing 102 of burner 100. Outer shroud 128 may be configured to constrain air immediately outside housing 102 to flow by convection radially inwardly to join exhaust products flowing upwardly from exhaust outlet 110, thereby further supporting secondary combustion and also interposing a thermally insulating barrier between lateral wall 106 of housing 102 and an exterior of burner 100. Similarly, air flowing upwardly past fuel holder 104, between fuel holder 104 and lateral wall 106, cools lateral wall 106 and conserves heat taken therefrom, returning recovered heat to flame and exhaust above exhaust outlet 110. Introduction of secondary and tertiary combustion air will in most cases cause secondary combustion of unburned and partially burned solid fuel 118 to burn so completely that visible smoke is largely eliminated. This decreases both fuel consumption and also air pollution.

An ash pan 130 may be releasably coupled to burner 100 below fuel holder 104. Ash pan 130 may comprise a floor 132 and a vertical peripheral wall 134 projecting upwardly from floor 132. Ash pan 130 thereby forms a sump capable of storing a supply of water 136 to extinguish burning embers (not shown) falling from fuel holder 104.

Figure 3:
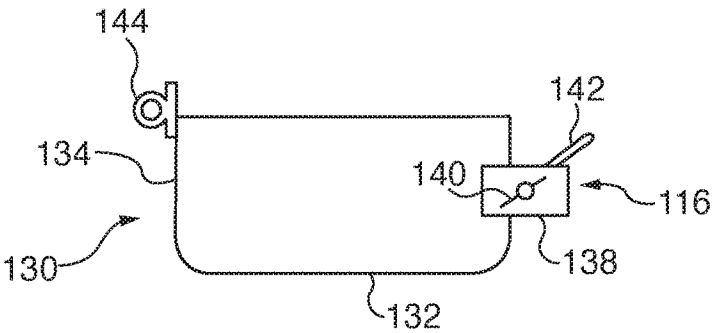
FIG. 3 is a schematic detail side view of optional components located at the lower central portion of FIG. 2.

Referring specifically to FIG. 3, air inlet opening 116 may open through vertical peripheral wall 134 of ash pan 130. To this end, air inlet opening 116 may include a conduit 138 and a damper 140 rotatably supported in conduit 138. A lever 142 controlling rotational position of damper 140 may be provided for manual throttling of combustion air.

Figure 4:
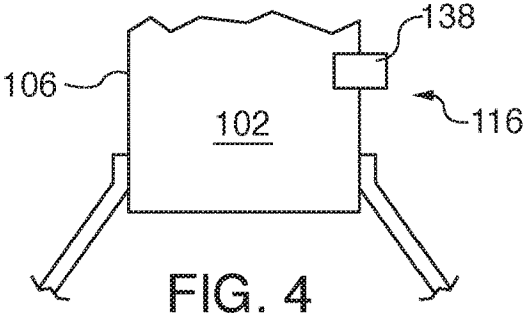
FIG. 4 is a schematic detail side view of the lowermost portion of FIGS. 1 and 2.

Referring specifically to FIG. 4, in some implementations of burner 100, air inlet opening 116 may open through lateral wall 106 of housing 102.

Referring specifically to FIG. 2, in some implementations of burner 100, ash pan 130 is permanently coupled to housing 102 and is movable between a closed position closing a bottom of housing 102 of burner 100 and an open position enabling removal of ashes from ash pan 130. The closed position is shown in solid lines in FIG. 2. The open position is shown in broken lines in FIG. 2. Ash pan 130 may be pivotally coupled to housing 102 by a hinge 144. Pivotal coupling of ash pan 130 retains the former to housing 102, and also facilitates draining water 136 from ash pan 130.

Figure 5:
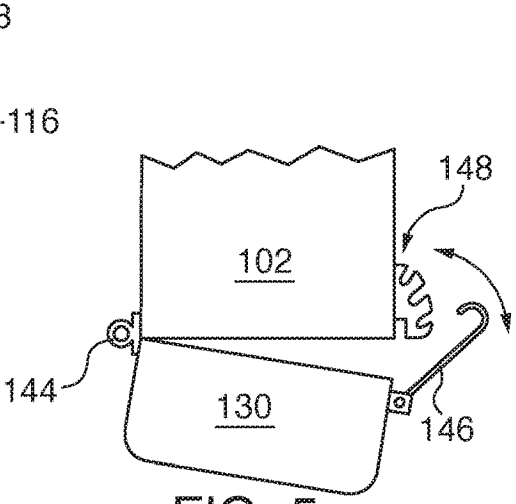
FIG. 5 is a schematic detail side view of components near the lower portion of FIG. 2.

As seen in FIG. 5, a hook 146 engageable with a multiple position catch 148 may be employed to secure ash pan 130 in any one of several degrees of inclination from the closed position shown in FIG. 2. Hook 146 may be pivotally mounted to ash pan 130 by a hinge 150. The degrees of inclination may be utilized to control the amount of combustion air entering the interior of housing 102.

In summary, burner 100 may comprise an air damper controlling volume of air flow through air inlet opening 116, the air damper being air damper 140, or alternatively, ash pan 130 serving as an air damper by virtue of its degree of inclination enabled by multiple position catch 148.

Referring to FIGS. 1, 2, and 4, burner 100 may comprise at least one leg 152 coupled to and projecting below burner 100, whereby burner 100 may be supported above a ground surface (not shown). Where one leg 152 is provided, leg 152 may be driven into the ground sufficiently deep as to prevent burner 100 from falling over. Alternatively, where one leg 152 is provided, leg 152 may include an extension (not shown) projecting beneath the center of gravity of burner 100. Where the latter alternative is provided, the extension will be sufficiently broad as to stably support burner 100 on the ground. As shown in FIGS. 1, 2, and 4, a plurality of legs 152, preferably three legs 152 distributed evenly around housing 102, may be provided. Leg(s) 152 provide sufficient clearance to enable ash pan 130 to be lowered into the open position shown in broken lines in FIG. 2 without lifting burner 100 from the ground.

As shown in FIG. 2, burner 100 may further comprise a cover 154 dimensioned and configured to close exhaust outlet 110 of burner 100. Burner 100 may comprise a hinge 158 pivotally coupling cover 154 to burner 100 by an arm 156. Cover 154 is solid or imperforate, and prevents inadvertent ingress of objects and a user's hand and fingers (none of these is shown) into combustion chamber 126. Cover 154 also prevents emission of live embers from combustion chamber 126. Cover 154 is shown in a stowed position in solid lines, and approaching a deployed position covering and substantially sealing exhaust outlet 110 in broken lines.

Burner 100 may further comprise a grill 160 attachable to housing 102 above exhaust outlet 110. Grill 160 includes openings (not shown) to enable hot gases to pass from combustion chamber 126 through grill 160. Burner 100 may further comprise a hinge 164 pivotally coupling grill 160 to housing 102 via an arm 162 supported on a post 166. Hinge 158 of cover 154 may be similarly supported to housing 102 by a post 168. Grill 160 is shown in a deployed position in solid lines and in a stowed position by broken lines in FIG. 2. Cover 154 and grill 160 may be located in diametric opposition on housing 102, or otherwise located to enable each to be lowered over exhaust outlet 110 without interfering with the other.

Figure 6:
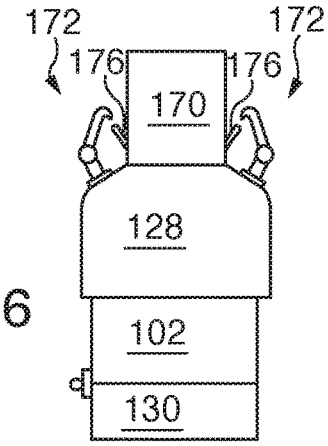
FIG. 6 is a schematic detail side view of an assembly incorporating the component shown in FIG. 2 with one of the modular heat utilizing appliances shown in FIG. 1, and represented generically in FIG. 6.

Turning now to FIG. 6, burner 100 may further comprise a coupling for detachably coupling a modular heat utilizing appliance 170 to burner 100. The coupling may comprise at least one draw latch 172. Two draw latches 172 located in diametric opposition on outer shroud 128 are depicted. However, one or more than two draw latches 172 could be utilized. Draw latches engage projections 176 in well known fashion. Modular heat utilizing appliance 170 generically represents any one of a number of different types of appliances, any one of which may be coupled to burner 100 at one time.

Again referring to FIG. 1, burner 100 may further comprise a modular heat utilizing appliance 170 (FIG. 6) further comprising a cooker 174A further comprising a cooker housing 178 including a bottom section 180 open to exhaust outlet 110 (FIG. 2) of burner 100, a top section 182 including a vent 184 for venting exhaust, and a support surface 186 inside cooker 174, for supporting items being cooked (not shown). Support surface 186 may comprise a wire rack for example. Cooker 174A is a closed cooker wherein food or other items being cooked are substantially enclosed, for example, to achieve higher cooking temperatures. Top section 182 rests on bottom section 180, and is readily lifted therefrom.

Cooker 174B presents an open, flat cooking surface 188. Cooker 174B may include internal baffles 190 to establish a serpentine flow path for exhaust gases from burner 100.

Cooker 174C, intended for smoking, may include a smoking chamber 192 enclosing a wire rack 194. Smoking chamber 192 is substantially sealed against loss of smoke, apart from vent pipe 194.

Burner 100 may further comprise a gas-to-gas heat exchanger 198, whereby environmental air can be heated for space heating. Gas-to-gas heat exchanger 198 may include internal baffles 200 and a vent 202. Gas-to-gas heat exchanger may transfer heat by convection, radiation, or both. A powered fan (not shown) may be provided to enhance heat transfer to air.

Figure 7:
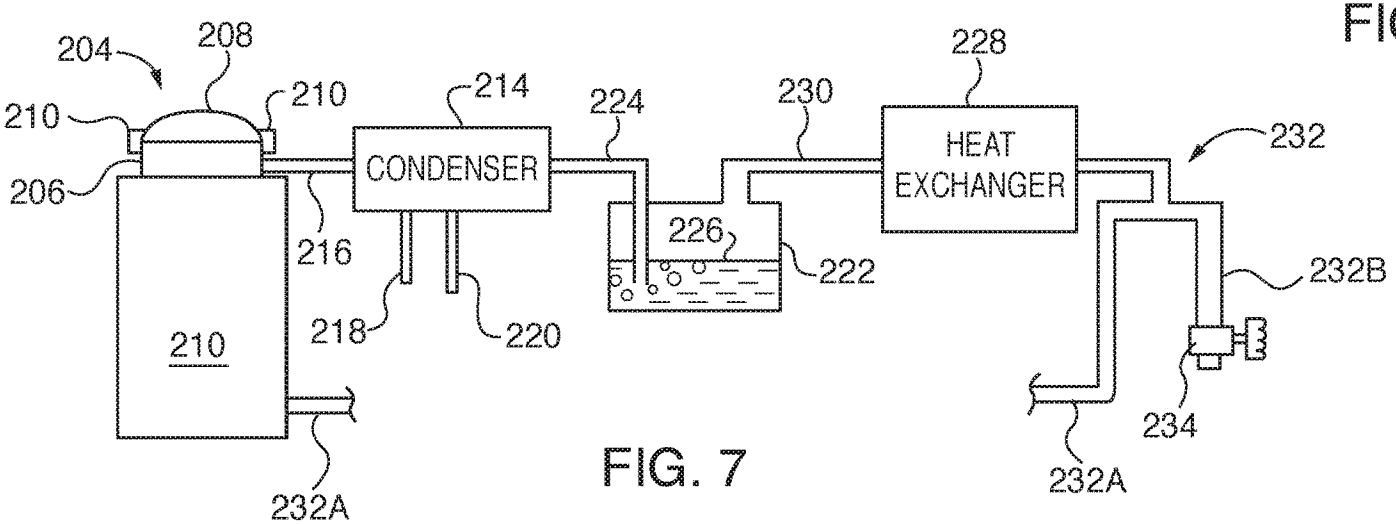
FIG. 7 is a schematic side view of components of a pyrolyzer partially shown in FIG. 1.

Referring also to FIG. 7, burner 100 may further comprise a modular heat utilizing appliance further comprising a pyrolyzer 204 including a substantially air-tight heating chamber 206 for pyrolyzing carboniferous materials, such as vegetation (not shown). Heating chamber 206 may include a tightly fitting cap 208 and latches 210 to securely retain cap 208 in place. Heating chamber 206 may be contained within a casing 210 surrounding heating chamber 206 and exposing heating chamber 206 to heat from burner 100. After transferring heat to heating chamber 206, products of combustion may be exhausted from vent 212.

Referring also to FIG. 7, pyrolyzer 204 may further comprise a condenser 214 for condensing vaporized liquid products of pyrolysis conducted to condenser 214 through a conduit 216 in communication with heating chamber 206. Condenser 214 is a heat exchanger causing vaporized liquid products of pyrolysis to be recovered as liquids. Liquids of different boiling points may be recovered separately, as represented by two capture conduits 218, 220. Gaseous products of pyrolysis may be conducted to a water chamber 222 through a conduit 224, and bubbled through water 226. Because heating chamber 206 is sealed, products of pyrolysis will be under sufficient pressure to overcome resistance of water 226. Gaseous products of pyrolysis may be conducted to a heat exchanger 228 through a conduit 230, and cooled to a predetermined temperature at which they are deemed safe. Cooled gaseous products of combustion may be collected in a bifurcated conduit 232 for subsequent distribution (conduit 232B) or use as a fuel in burner 100 (conduit 232A). Conduits 232A, 232B will be understood to include valves (not shown) and other components to achieve functions described herein.

To these ends, pyrolyzer 204 may further comprise conduit 216, 224, 230, 232, 232A in fluid communication with substantially air-tight heating chamber 206 and with burner 100, whereby vaporized products of pyrolysis may be conducted to burner 100 for supplementing solid fuel 118 in fuel holder 104, or for entirely eliminating use of solid fuel 118. Also, pyrolyzer 204 may further comprise conduits 216, 224, 230, 232, 232B in fluid communication with substantially air-tight heating chamber 206, an outlet (conduit 232B) for conducting vaporized products of pyrolysis to an external conduit or storage receptacle (neither shown), and a shutoff valve 234 in the conduit, the shutoff valve enabling control over flow of vaporized products of pyrolysis conducted to the outlet.

Burner 100 may be provided with a fuel feed feature (not shown) to enable renewing the fuel supply during operation, to enable continuous, long term operation. The fuel feed feature may comprise a door in the outermost wall of burner 100, and optionally, a chute leading from the door to the opening over exhaust outlet 110. Solid fuel loaded through the door and forced along the chute will drop into fuel holder 104.

While the present invention has been described in connection with what are considered the most practical exemplary embodiments, it is to be understood that the present embodiments are not to be limited to the disclosed arrangements, but rather the description is intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

What is claimed:

1. A burner for a heat utilizing appliance, comprising:

a housing and a fuel holder within the housing, wherein the housing comprises a lateral wall surrounding and spaced apart from the fuel holder, a top wall including a constricted exhaust outlet of transverse dimensions less than transverse dimensions of the lateral wall, the constricted exhaust outlet located above the fuel holder, an ash pan pivotally coupled to the burner below the fuel holder so that the ash pan is pivotable between a closed position closing a bottom of the housing of the burner and an open position enabling removal of ashes from the ash pan, a plurality of legs coupled to the housing allowing sufficient clearance to enable the ash pan to be pivoted to the open position without lifting the burner from the ground, an outer shroud surrounding and spaced apart from an upper portion of the housing of the burner, the outer shroud configured to constrain air immediately outside the housing to flow by convection radially inwardly to join exhaust products flowing upwardly from the exhaust outlet, thereby interposing a thermally insulating barrier between the lateral wall of the housing and an exterior of the burner, an air inlet opening admitting air to the fuel holder, wherein the lateral wall, the outer shroud, and the top wall are collectively configured to guide inducted air flowing around the fuel holder inwardly from a periphery of the housing to join exhaust products flowing upwardly through the exhaust outlet when solid fuel is being burned in the fuel holder, thereby supporting secondary combustion above the fuel holder.

2. The burner of claim 1, wherein the air inlet opening opens through the lateral wall of the housing.

3. The burner of claim 1, wherein the ash pan comprises a floor and a vertical peripheral wall projecting upwardly from the floor, whereby the ash pan forms a sump capable of storing a supply of water to extinguish burning embers falling from the fuel holder.

4. The burner of claim 3, wherein the air inlet opening opens through the vertical peripheral wall of the ash pan.

5. The burner of claim 1, wherein the fuel holder comprises a perforate receptacle enabling air inducted from the air inlet opening to come into combustion support relation to fuel in the fuel holder.

6. The burner of claim 5, wherein the fuel holder comprises an imperforate lateral wall above the perforate receptacle.

7. The burner of claim 1, further comprising an air damper controlling volume of air flow through the air inlet opening.

8. The burner of claim 1, further comprising a cover dimensioned and configured to close the exhaust outlet of the burner.

9. The burner of claim 1, further comprising a grill attachable to the housing above the exhaust outlet.

10. A combination of a burner and a modular heat utilizing appliance, comprising:

(i) a burner comprising:

a housing and a fuel holder within the housing, wherein the housing comprises a lateral wall surrounding and spaced apart from the fuel holder, a top wall including a constricted exhaust outlet of transverse dimensions less than transverse dimensions of the lateral wall, the constricted exhaust outlet located above the fuel holder, an ash pan pivotally coupled to the burner below the fuel holder so that the ash pan is pivotable between a closed position closing a bottom of the housing of the burner and an open position enabling removal of ashes from the ash pan, a plurality of legs coupled to the housing allowing sufficient clearance to enable the ash pan to be pivoted to the open position without lifting, the burner from the ground, an outer shroud surrounding and spaced apart from an upper portion of the housing of the burner, the outer shroud configured to constrain air immediately outside the housing, to flow by convection radially inwardly to join exhaust products flowing upwardly from the exhaust outlet thereby interposing a thermally insulating barrier between the lateral wall of the housing and an exterior of the burner, and an air inlet opening admitting air to the fuel holder, wherein the lateral wall, the outer shroud, and the top wall are collectively configured to guide inducted air flowing around the fuel holder inwardly from a periphery of the housing to join exhaust products flowing upwardly through the exhaust outlet when solid fuel is being burned in the fuel holder, thereby supporting secondary combustion above the fuel holder; and (ii) a modular heat utilizing appliance, wherein a coupling detachably couples the modular heat utilizing appliance to the burner.

11. The combination of claim 10, wherein the coupling comprises at least one draw latch.

12. The combination of claim 10, wherein the modular heat utilizing appliance comprises a cooker comprising a cooker housing including a bottom section open to the exhaust outlet of the burner, a top section including a vent for venting exhaust, and a support surface inside the cooker, for supporting items being cooked.

13. The combination of claim 10, wherein the modular heat utilizing appliance comprises a gas-to-gas heat exchanger, whereby environmental air can be heated for space heating.

14. The combination of claim 10, wherein the modular heat utilizing appliance comprises a pyrolyzer including a substantially air-tight heating chamber for pyrolyzing carboniferous materials.

15. The combination of claim 14, wherein the pyrolyzer further comprises a conduit in fluid communication with the substantially air-tight heating chamber and with the burner, whereby vaporized products of pyrolysis may be conducted to the burner for supplementing solid fuel in the fuel holder.

* * * * *